US008085231B2

(12) United States Patent
Kurihara et al.

(10) Patent No.: US 8,085,231 B2
(45) Date of Patent: Dec. 27, 2011

(54) DISPLAY DEVICE

(75) Inventors: Hiroshi Kurihara, Mobara (JP); Tatsuo Makishima, Katsushika (JP)

(73) Assignee: Hitachi Displays, Ltd., Chiba (JP)

( * ) Notice: Subject to any disclaimer, the term of this patent is extended or adjusted under 35 U.S.C. 154(b) by 588 days.

(21) Appl. No.: 12/318,269

(22) Filed: Dec. 23, 2008

(65) Prior Publication Data

US 2009/0179922 A1 Jul. 16, 2009

(30) Foreign Application Priority Data

Jan. 11, 2008 (JP) ..... 2008-003849

(51) Int. Cl.
*G09G 3/36* (2006.01)

(52) U.S. Cl. ..... 345/89; 345/690

(58) Field of Classification Search ..... 345/87–89, 345/94, 95, 98, 100, 211–213, 690
See application file for complete search history.

(56) References Cited

U.S. PATENT DOCUMENTS

| | | | | |
|---|---|---|---|---|
| 6,437,716 | B2 * | 8/2002 | Nakao | 341/118 |
| 6,697,040 | B2 | 2/2004 | Imajo et al. | |
| 2003/0132906 | A1 * | 7/2003 | Tanaka et al. | 345/89 |
| 2005/0013143 | A1 * | 1/2005 | Kim et al. | 363/20 |
| 2005/0122300 | A1 * | 6/2005 | Makuuchi et al. | 345/95 |
| 2005/0212597 | A1 * | 9/2005 | Tsuchi | 330/253 |
| 2006/0139065 | A1 * | 6/2006 | Kojima et al. | 327/108 |
| 2006/0232577 | A1 * | 10/2006 | Edwards et al. | 345/211 |
| 2007/0008347 | A1 * | 1/2007 | Choi | 345/690 |
| 2007/0195080 | A1 * | 8/2007 | Lee | 345/211 |
| 2007/0228170 | A1 * | 10/2007 | Pettinelli et al. | 235/462.06 |

FOREIGN PATENT DOCUMENTS

| | | |
|---|---|---|
| JP | 2001-306040 | 11/2001 |

* cited by examiner

*Primary Examiner* — Ricardo L Osorio
(74) *Attorney, Agent, or Firm* — Stites & Harbison PLLC; Juan Carlos A. Marquez, Esq.

(57) ABSTRACT

In a display device which mounts drive circuits and a display control circuit on a substrate which constitutes a display panel, signal lines can be arranged on the substrate which constitutes the display panel without making the signal lines intersect each other. A plurality of drive circuits and a display control circuit are mounted on a peripheral portion of one long side of a first substrate. A printed circuit board is connected to one long side of the first substrate. Each drive circuit mounts, on a surface thereof facing the first substrate, a group of power source voltage input terminals to which a power source voltage is supplied, a group of gray-scale reference voltage input terminals to which a gray-scale reference voltage is supplied, and a group of gray-scale reference voltage output terminals which sends gray-scale reference voltages.

7 Claims, 7 Drawing Sheets

DISPLAY DEVICE

BACKGROUND OF THE INVENTION

1. Field of the Invention

The present invention relates to a display device, and more particularly to a technique which is effectively applicable to a display device which transfers digital signals between drive circuits.

2. Description of the Related Art

A TFT (Thin Film Transistor)-method liquid crystal display module which adopts thin film transistors as active elements has been popularly used as a display device of a personal computer and the like. Such a liquid crystal display device includes a liquid crystal display panel and drive circuits for driving the liquid crystal display panel.

Further, in such a liquid crystal display module, for example, as disclosed in patent document JP-A-2001-306040, there has been known a method (hereinafter, referred to as a digital-signal sequential transfer method) which supplies digital signals (for example, display data or a clock signals) only to a start drive circuit out of drive circuits (drain drivers or gate drivers) which are connected with each other by cascade connection and sequentially transfers the digital signals to other drive circuits through the inside of the drive circuits.

In a liquid crystal display device disclosed in JP-A-2001-306040, semiconductor chips (IC) which constitute drive circuits (drain drivers or gate drivers) are directly mounted on a substrate (for example, glass substrate) which constitutes a liquid crystal display panel. Further, power source voltages of the respective drain drivers are supplied from a power source circuit via a flexible circuit board which is connected to the liquid crystal display panel.

SUMMARY OF THE INVENTION

In the liquid crystal display device disclosed in JP-A-2001-306040, a display control circuit (timing controller) is not mounted on the substrate which constitutes the liquid crystal display panel. However, there may be a case that the display control circuit (timing controller) is also mounted on the substrate which constitutes the liquid crystal display panel.

Further, when the display control circuit (timing controller) is mounted on the substrate which constitutes the liquid crystal display panel and the power source voltage and a gray-scale reference voltage are supplied from the outside of the substrate which constitutes the liquid crystal display panel, it is necessary to arrange lines for supplying signals (display data, control signals) from the display control circuit (timing controller) to the drain driver and lines for supplying the power source voltage and the gray-scale reference voltage from the outside without making these lines intersect each other.

However, in JP-A-2001-306040, no consideration is taken into with respect to the arrangement of terminals (bump electrodes) of the drain drivers.

The present invention has been made to overcome the above-mentioned drawbacks of the related art and it is an object of the present invention to provide a technique which can, in a display device which mounts drive circuits and a display control circuit on a substrate constituting a display panel, perform wiring of signal lines on the substrate constituting the display panel without making the signal lines intersect each other.

The above-mentioned and other objects and novel features of the present invention will become apparent based on the description of this specification and attached drawings.

To briefly explain typical invention among inventions disclosed in this application, they are as follows.

A display device includes a display panel including a plurality of pixels, a plurality of drive circuits for supplying video voltages to the respective pixels, and a display control circuit which performs a drive control of the plurality of drive circuits.

The display panel includes a first substrate, and the plurality of drive circuits and the display control circuit are mounted on a peripheral portion of one long side of the first substrate. A circuit board is connected to one long side of the first substrate.

Each drive circuit includes a group of power source voltage input terminals to which a power source voltage is supplied, a group of gray-scale reference voltage input terminals to which a gray-scale reference voltage is supplied, and a group of gray-scale reference voltage output terminals which transmits a gray-scale reference voltage on a surface thereof facing the first substrate.

The group of power source voltage input terminals, the group of gray-scale reference voltage input terminals, and the group of gray-scale reference voltage output terminals are arranged along a circuit-board-side long side of each drive circuit.

The group of power source voltage input terminals is arranged between the group of gray-scale reference voltage input terminals and the group of gray-scale reference voltage output terminals.

The group of gray-scale reference voltage input terminals is arranged on a display-control-circuit side of the group of power source voltage input terminals. The group of gray-scale reference voltage output terminals is arranged on a side opposite to the display control circuit side of the group of power source voltage input terminals.

A power source voltage is supplied to the group of power source voltage input terminals of each drive circuit via the printed circuit board. A gray-scale reference voltage is supplied to the group of gray-scale reference voltage input terminals of the start drive circuit via the printed circuit board.

A gray-scale reference voltage which is sent from the group of gray-scale reference voltage output terminals of the drive circuit of a preceding stage is supplied to the drive circuits other than the start drive circuit.

The group of power source voltage input terminals is arranged on a center portion of each drive circuit. Each drive circuit includes a group of display data input terminals and a group of display data output terminals on a surface thereof facing the first substrate.

Assuming the clockwise direction as the first direction and assuming the counterclockwise direction as the second direction as viewed from a surface of each drive circuit on a side opposite to the surface of the drive circuit facing the first substrate, the group of display data input terminals is arranged in front of the group of gray-scale reference voltage output terminals in the first direction. The group of display data output terminals is arranged in front of the group of gray-scale reference voltage output terminals in the second direction.

Display data sent from the display control circuit is supplied to the group of display data input terminals of the start drive circuit, and display data which is sent from the group of display data output terminals of the drive circuit of a preceding stage is supplied to the drive circuits other than the start drive circuit.

Each drive circuit includes a group of control signal input terminals and a group of control signal output terminals on a surface thereof facing the first substrate. The group of control signal input terminals is arranged in front of the group of display data input terminals in the first direction.

The group of control signal output terminals is arranged in front of the group of display data output terminals in the second direction.

Control signals sent from the display control circuit are supplied to the group of control signal input terminals of the start drive circuit. Control signals sent from the group of control signal output terminals of the drive circuit of a preceding stage are supplied to the drive circuits other than the start drive circuit.

The group of display data input terminals is arranged along a display-control-circuit-side short side of each drive circuit. The group of display data output terminals is arranged along a short side of each drive circuit on a side opposite to the display control circuit.

The group of control signal input terminals is arranged along a display-control-circuit-side long side of each drive circuit on a side of each drive circuit opposite to the printed circuit board. The group of control signal output terminals is arranged along a long side of each drive circuit opposite to the display control circuit on a side of each drive circuit opposite to the printed circuit board.

A power source circuit and a gray-scale reference voltage generating circuit are mounted on the printed circuit board. A storage means for storing the gray-scale reference voltage data is mounted on the printed circuit board. The gray-scale reference voltage generating circuit includes a register, and the display control circuit reads the gray-scale reference data stored in the storage means and outputs the gray-scale reference data to the gray-scale reference voltage generating circuit.

The gray-scale reference voltage generating circuit stores the gray-scale reference voltage data input from the display control circuit in the register, and generates gray-scale reference voltages based on the gray-scale reference voltage data stored in the register.

To briefly explain an advantageous effect acquired by typical invention among the inventions disclosed in this application, they are as follows.

According to the present invention, in the display device which mounts the drive circuits and the display control circuit on the substrate which constitutes the display panel, it is possible to arrange signal lines on the substrate which constitutes the display panel without making the signal lines intersect each other.

DETAILED DESCRIPTION OF THE EMBODIMENTS

Hereinafter, an embodiment of the present invention is explained in detail in conjunction with drawings.

Here, in all drawings for explaining the embodiment, parts having identical functions are given the same symbols, and their repeated explanation is omitted.

Figure 1:
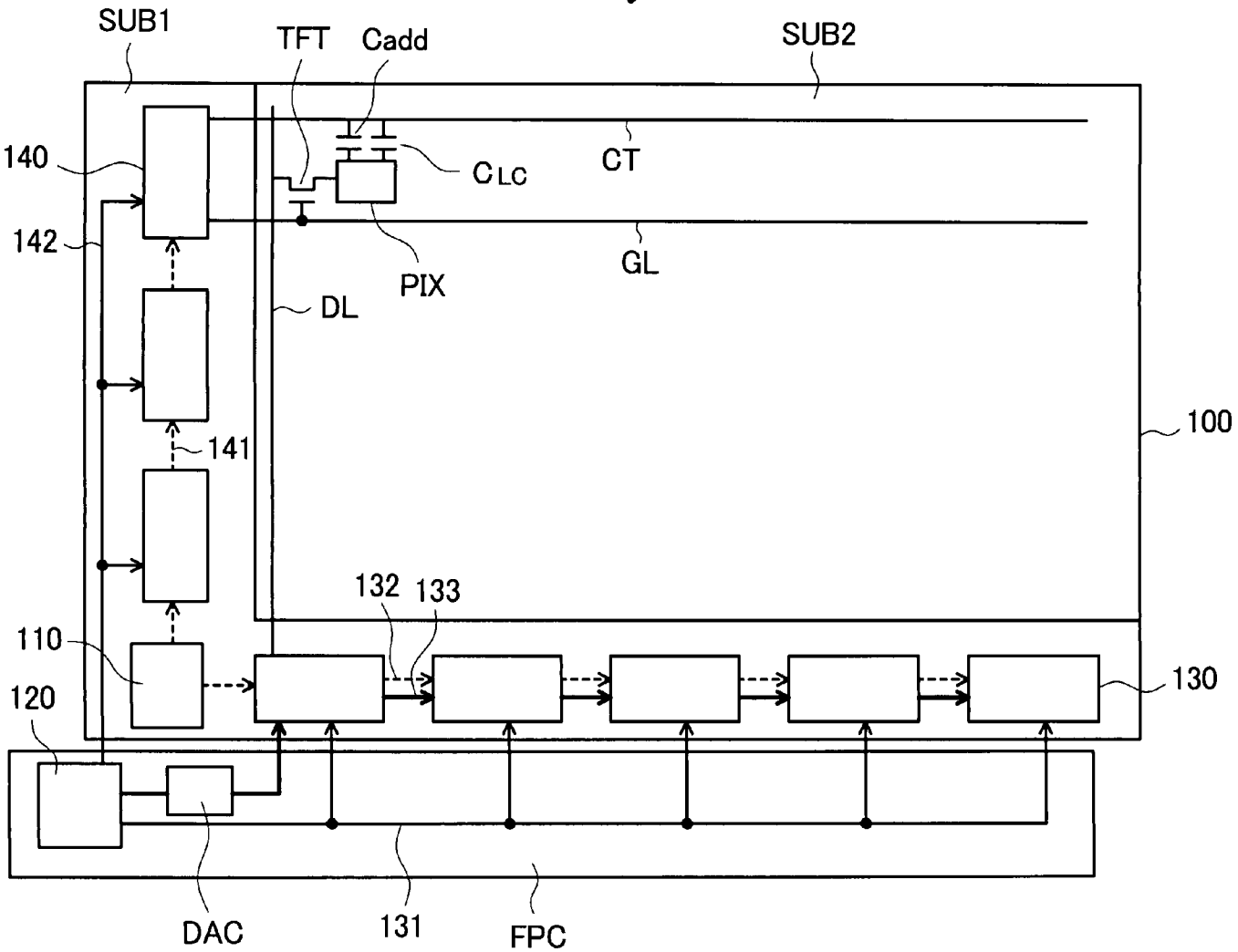
FIG. 1 is a block diagram showing the basic constitution of a liquid crystal display device of an embodiment according to the present invention.

FIG. 1 is a block diagram showing the basic constitution of the liquid crystal display device of the embodiment according to the present invention.

A liquid crystal display panel 100 includes a first substrate (for example, a glass plate; also referred to as a TFT substrate) (SUB1) on which pixel electrodes, thin film transistors and the like are formed, and a second substrate (for example, a glass plate; also referred to as a CF substrate) (SUB2) on which color filters and the like are formed.

The liquid crystal display panel 100 is constituted such that the first and second substrates are made to overlap with each other with a predetermined gap therebetween, both substrates are adhered to each other using a sealing material which is formed in a frame shape in the vicinity of peripheral portions of both substrates and, at the same time, liquid crystal is filled into a space defined by the sealing material between both substrates through a liquid-crystal filling port formed in a portion of the sealing material and, then, a polarizer is adhered to outer sides of both substrates.

As described above, the liquid crystal display panel of this embodiment is configured such that the liquid crystal is sandwiched between the pair of substrates. Here, it is sufficient that the substrate is formed of an insulation substrate. That is, the substrate is not limited to the glass substrate and may be formed of a plastic substrate.

Here, the present invention is irrelevant to the internal structure of the liquid crystal display panel and hence, the detailed explanation of the internal structure of the liquid crystal display panel is omitted. Further, the present invention is applicable to a liquid crystal display panel having any other structure.

Further, although the liquid crystal display device of this embodiment includes a backlight which is arranged on a back side of the liquid crystal display panel, the present invention is irrelevant to the internal structure of the backlight and hence, the detailed explanation of the internal structure of the backlight is omitted.

Each pixel (sub pixel) includes a pixel electrode (PIX) and a thin film transistor (TFT), and the pixels are arranged corresponding to portions where a plurality of scanning lines (or gate lines) (GL) and a plurality of video lines (or drain lines, source lines) (DL) intersect each other.

Further, a liquid crystal layer is sandwiched between the pixel electrode (PIX) and a counter electrode (CT) and hence, a liquid crystal capacitance (CLC) is formed between the pixel electrode (PIX) and the counter electrode (CT). Further, to hold a potential of the pixel electrode (PIX), a holding capacitance (Cadd) is formed between the pixel electrode (PIX) and the counter electrode (CT) for every pixel.

Further, in FIG. 1, although only one pixel electrode (PIX) is shown, the plurality of pixel electrodes (PIX) and the plurality of thin film transistors (TFT) are respectively arranged in a matrix array. Further, the counter electrodes (CT) are formed on a second substrate (SUB2) side in case of a TN-type or VA-type liquid crystal display panel. In case of an IPS-type liquid crystal display panel, the counter electrodes (CT) are formed on the first substrate (SUB1) side.

With respect to the thin film transistor (TFT) of each sub pixel, a source of the thin film transistor is connected to the pixel electrode (PIX), a drain of thin film transistor is connected to the video line (DL) and a gate of thin film transistor is connected to the scanning line (GL). Accordingly, the thin film transistor (TFT) functions as a switch for supplying a video voltage (gray-scale voltage) to the pixel electrode (PIX).

The video lines (DL) are connected to drain drivers 130, and the video voltages are supplied to the video lines (DL) from the drain drivers 130. Further, the scanning lines (GL) are connected to gate drivers 140, and selective scanning voltages or non-selective scanning voltages are supplied to the scanning lines (GL) from the gate drivers 140. Here, each drain driver 130 is formed of one semiconductor chip (IC), and each gate driver 140 is also formed of one semiconductor chip (IC).

A display control circuit (timing controller) 110, the drain drivers 130 and the gate drivers 140 are respectively mounted on two peripheral portions of the first substrate (SUB1) of the liquid crystal display panel 100.

Further, a power source circuit 120 and a gray-scale reference voltage generating circuit (DAC) are mounted on a flexible circuit board (hereinafter, simply referred to as a circuit board) (FPC) which is connected to one long side of the liquid crystal display panel 100.

The display control circuit 110 is constituted of one semiconductor integrated circuit (LSI), and the display control circuit 110 controls and drives the drain drivers 130 and the gate drivers 140 based on display control signals (SCL) and display data (DATA) transmitted from a host computer.

Here, the display control signal (SCL) includes a clock signal (CK), a display timing signal (DTMG), a horizontal synchronizing signal (HSYNC), and a vertical synchronizing signal (VSYNC). For example, the display data (DATA) is constituted of display data of 6 bits for every R, G, B.

The display data/control signal 132 which is sent from the display control circuit 110 is supplied to the start drain driver 130, and propagates through internal signal lines arranged in the respective drain drivers 130 and transfer lines (a line layer on the first substrate (SUB1)) connecting between the respective drain driers 130, hence the display data/control signal 132 is supplied into the respective drain drivers 130.

A gray-scale reference voltage 133 which is sent from the gray-scale voltage generating circuit (DAC) is supplied to the start drain driver 130 via the printed circuit board (FPC), and propagates through internal signal lines in the respective drain drivers 130 and transfer lines (the line layer on the first substrate (SUB1)) between the respective drain drivers 130 and is supplied to the respective drain drivers 130. Further, the power source voltage for the respective drain drivers 130 is supplied to the respective drain drivers 130 from the power source circuit 120 via a power source line 131 arranged on the printed circuit board (FPC).

In the same manner as described above, a control signal 141 which is sent from the display control circuit 110 is supplied into the start gate driver 140, and propagates through internal signal lines in the respective gate drivers 140 and transfer lines (the line layer on the first substrate (SUB1)) between the respective gate drivers 140 and is supplied to the respective gate drivers 140.

Further, the power source voltage such as gate-ON voltage (Vgh) for the respective gate drivers 140 is respectively supplied to the respective gate drives 140 from the power source circuit 120 via a power source line 142 arranged on the first substrate (SUB1) of the liquid crystal display panel 100.

Figure 6:
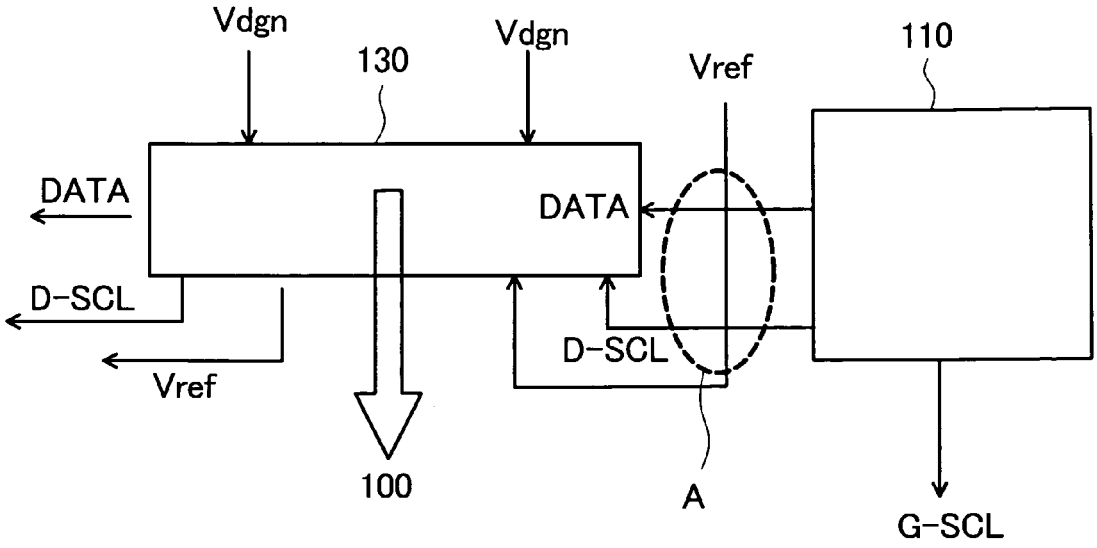
FIG. 6 is a view for explaining a drawback of a liquid crystal display device which uses drain drivers having the general arrangement of terminals and mounts the drain drivers and a display control circuit on a first substrate.
Figure 7:
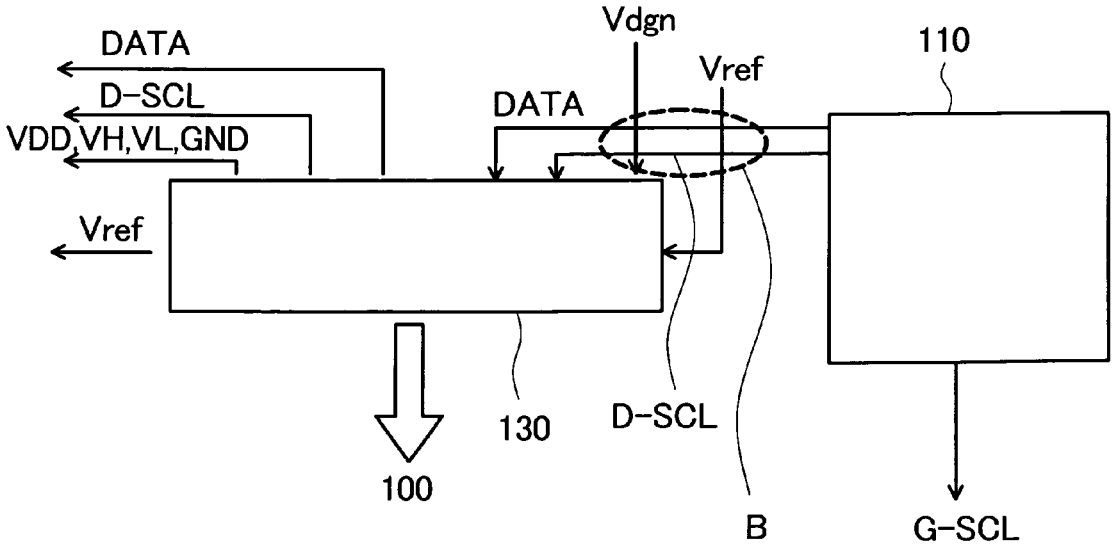
FIG. 7 is a view for explaining a drawback of a liquid crystal display device which uses drain drivers having the general arrangement of terminals and mounts the drain drivers and a display control circuit on a first substrate.
Figure 8:
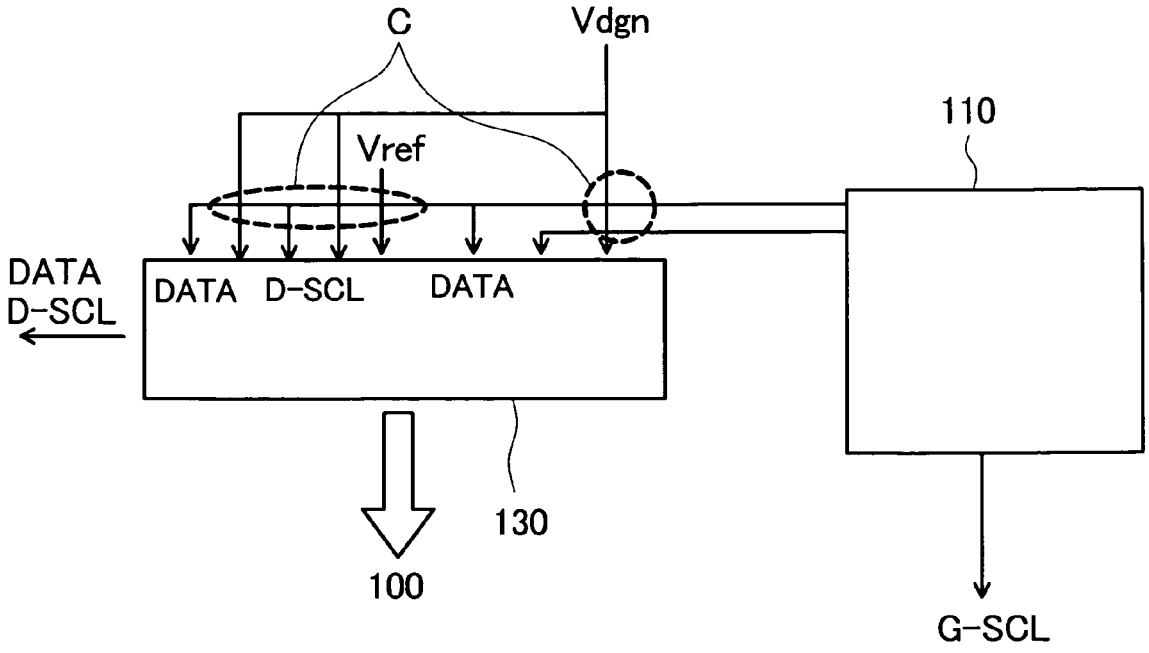
FIG. 8 is a view for explaining a drawback of a liquid crystal display device which uses drain drivers having the general arrangement of terminals and mounts the drain drivers and a display control circuit on a first substrate.

FIG. 6 to FIG. 8 are views for explaining a drawback of the liquid crystal display device which uses the drain drivers 130 having the general arrangement of terminals (bump electrode) and mounts the drain drivers 130 and the display control circuit 110 on the first substrate (SUB1).

With respect to the arrangement of terminals of the drain driver 130 shown in FIG. 6, a gray-scale reference voltage (Vref) which is supplied from the printed circuit board (FPC) is supplied to a group of terminals which is formed on and along a long side of the drain driver 130 on a side of the second substrate (SUB2). Accordingly, at a position indicated by a dotted line frame A in FIG. 6, the line which is arranged on the first substrate (SUB1) for supplying the gray-scale reference voltage (Vref) to the drain driver 130 from the printed circuit board (FPC) and lines for supplying the display data (DATA) and a control signal (D-SCL) which are sent from the display control circuit 110 to the drain drivers 130 intersect each other.

Here, the gray-scale reference voltage (Vref) is, for example, constituted of thirteen gray-scale reference voltages of V0 to V12.

In the arrangement of terminals of the drain driver 130 shown in FIG. 7, the display data (DATA) and the control signal (D-SCL) which are sent from the display control circuit 110 are supplied to a group of terminals which is formed on and along a long side of the drain driver 130 on a side of the liquid crystal display panel 100. Accordingly, at a position indicated by a dotted line frame B shown in FIG. 7, the lines formed on the first substrate (SUB1) for supplying a power source voltage (Vdgn) and the gray-scale reference voltage (Vref) from the printed circuit board (FPC) and lines for supplying the display data (DATA) and the control signal (D-SCL) which are sent from the display control circuit 110 to the drain drivers 130 intersect each other.

Here, for example, the power source voltage (Vdgn) may include a power source voltage (VDD) for the drain drivers 130, aground voltage (GND), and voltages other than the power source voltage (VDD) and the ground voltage (GND).

Also in the arrangement of terminals of the drain driver 130 shown in FIG. 8, the display data (DATA) and the control signal (D-SCL) which are sent from the display control circuit 110 are supplied to the group of terminals which is formed on and along the long side of the drain driver 130 on a side of the liquid crystal display panel 100. Accordingly, at positions indicated by dotted line frames C in FIG. 8, lines on the first substrate (SUB1) for supplying the power source voltage (Vdgn) and the gray-scale reference voltage (Vref) from the printed circuit board (FPC) and lines for supplying the display data (DATA) and the control signal (D-SCL) which are sent from the display control circuit 110 to the drain driver 130 intersect each other.

Figure 2:
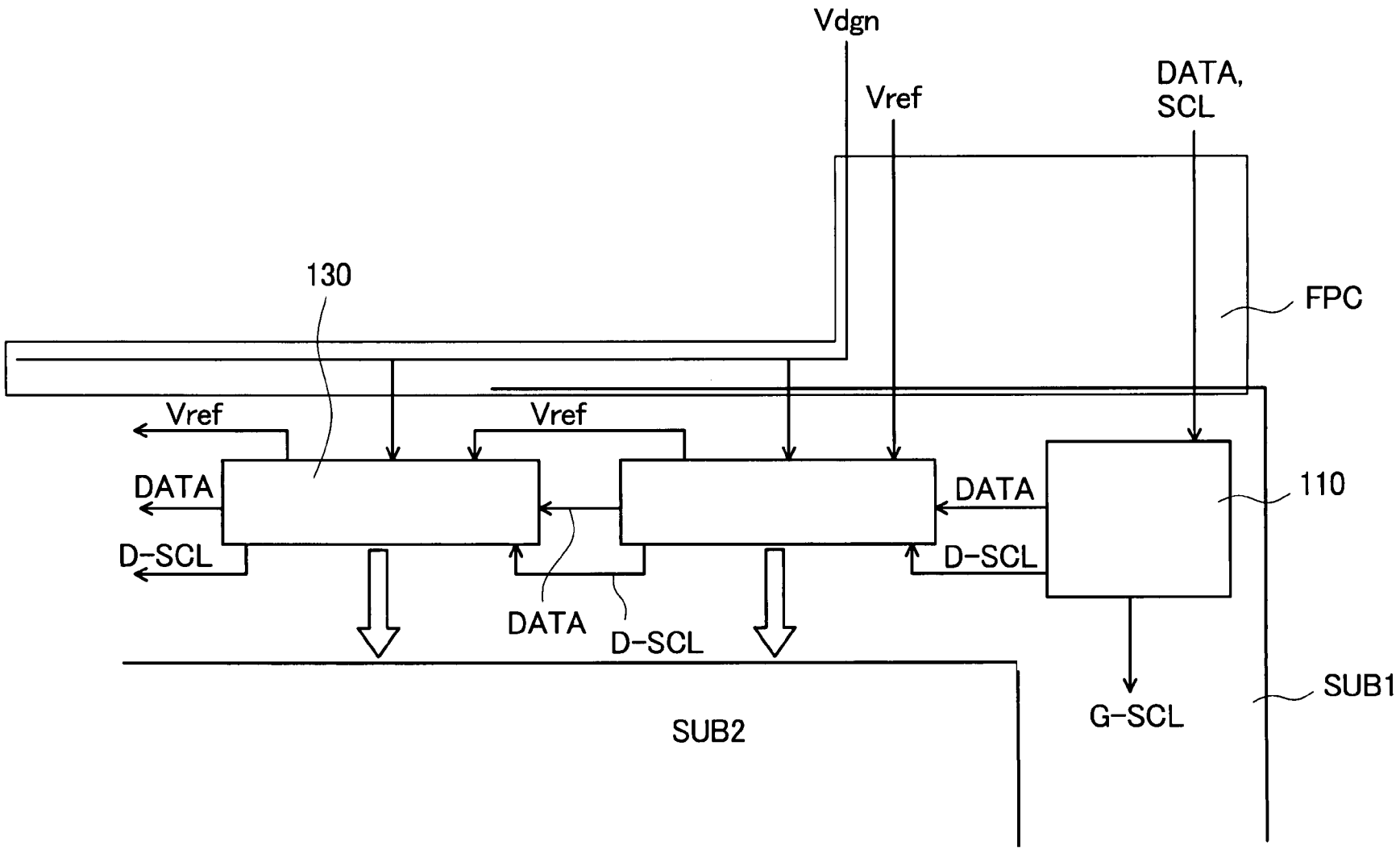
FIG. 2 is a view for explaining one example of the specific constitution of the liquid crystal display device of the embodiment according to the present invention.

FIG. 2 is a view for explaining one example of the more specific constitution of the liquid crystal display device of this embodiment.

In this embodiment, a power source voltage (Vdgn) which is supplied from the printed circuit board (FPC) is supplied to a group of terminals which is formed on a center portion of a printed-circuit-board side of each drain driver 130.

Further, a gray-scale reference voltage (Vref) which is supplied from the printed circuit board (FPC) is supplied to a group of terminals which is formed along a printed-circuit-board side of the drain drivers 130 and is arranged on an edge of display-control-circuit-110 side of the drain drivers 130, and a gray-scale reference voltage (Vref) which is sent from the drain drivers 130 is sent from a group of terminals which is formed along an edge of printed-circuit-board side of the drain drivers 130 and is arranged on a side of the drain drivers 130 opposite to the display control circuit 110.

Due to such constitution, it is possible to overcome the drawback explained in conjunction with FIG. 6 to FIG. 8, that is, the drawback that the line on the first substrate (SUB1) for supplying the power source voltage (Vdgn) or the gray-scale reference voltage (Vref) from the printed circuit board (FPC) and the lines for supplying the display data (DATA) and the control signal (D-SCL) which are sent from the display control circuit 110 to the drain driver 130 intersect each other.

Here, in FIG. 2, the power source circuit 120 and the gray-scale reference voltage generating circuit (DAC) are not mounted on the printed circuit board (FPC). Accordingly, the power source voltage (Vdgn) or the gray-scale reference voltage (Vref) is supplied from the outside. As described above, in this embodiment, it is not always necessary to mount the power source circuit 120 and the gray-scale reference voltage generating circuit (DAC) on the printed circuit board (FPC).

Here, for example, the control signal (D-SCL) may include a start pulse, an AC signal (M), and clock signals (CL1, CL2). Further, in FIG. 2, symbol G-SCL indicates a control signal supply to the gate driver 140, and the control signal (G-SCL) may include a frame start signal (FLM), and a clock signal (CL3), for example.

Figure 4:
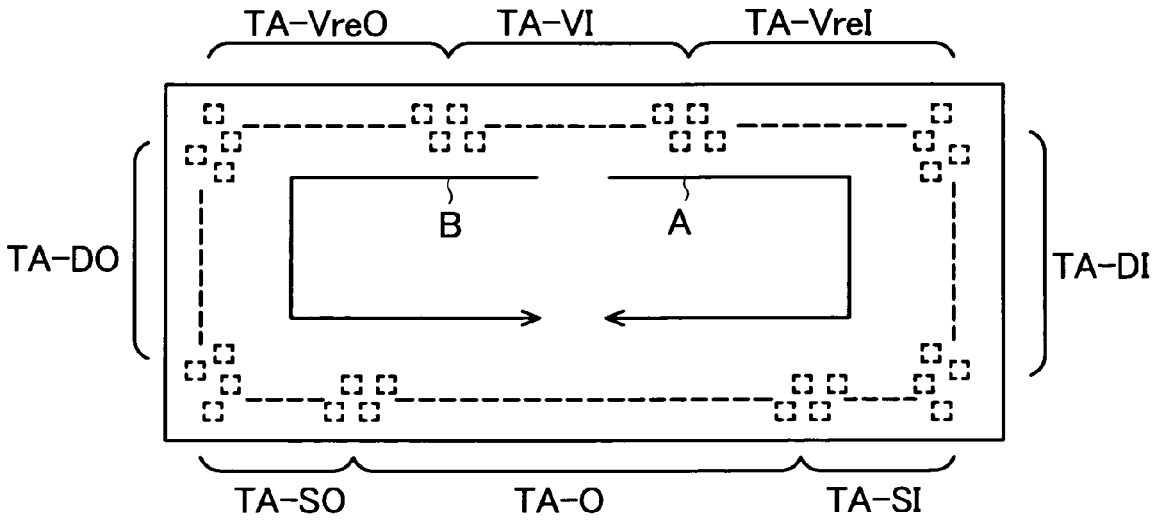
FIG. 4 is a view for explaining the arrangement of terminals (bump electrodes) of drain drivers of the embodiment according to the present invention.

Hereinafter, the arrangement of terminals (bump electrodes) of the drain driver 130 of this embodiment is explained in conjunction with FIG. 4. Here, FIG. 4 is a view showing the arrangement of terminals of the drain driver 130 as viewed from a surface of the drain driver 130 on a side opposite to a surface of the drain driver 130 facing the first substrate (SUB1).

Here, assume the clockwise direction as the first direction (the direction indicated by an arrow A in FIG. 4) and assume the counterclockwise direction as the second direction (the direction indicated by an arrow B in FIG. 4) as viewed from the surface of the drain driver 130 on a side opposite to the surface of the drain driver 130 facing the first substrate (SUB1). In this case, a group of input terminals (TA-VI) for a power source voltage (Vdd) is arranged on a center portion of the terminals formed along a printed-circuit-board-side long side of the drain driver 130.

A group of input terminals (TA-VreI) for a gray-scale reference voltage (Vref), a group of input terminals (TA-DI) for display data (DATA) and a group of input terminals (TA-SI) for control signals are arranged in order in the first direction from the group of input terminals (TA-VI) for the power source voltage (Vdgn).

Further, a group of output terminals (TA-VreO) for the gray-scale reference voltage (Vref), a group of output terminals (TA-DO) for display data (DATA) and a group of output terminals (TA-SO) for control signals are arranged in order in the second direction from the group of input terminals (TA-VI) for the power source voltage (Vdgn).

That is, the group of input terminals (TA-VI) for the power source voltage (Vdgn), the group of input terminals (TA-VreI) for the gray-scale reference voltage (Vref) and the group of output terminals (TA-VreO) for the gray-scale reference voltage (Vref) are arranged along the printed-circuit-board-side long edge of the drain driver 130, the group of input terminals (TA-DI) for the display data (DATA) is arranged along a display-control-circuit-side short edge of the drain driver 130, the group of output terminals (TA-DO) for the display data (DATA) is arranged along a short edge of the drain driver 130 on a side opposite to the display control circuit 110, the group of input terminals (TA-SI) for the control signal is arranged along a display-control-circuit-side long edge of the drain driver 130 on a side opposite to the printed circuit board (FPC), and the group of output terminals (TA-SO) for the control signals is arranged along a long edge of the drain driver 130 opposite to the display control circuit 110 on a side opposite to a printed circuit board (FPC) of the drain driver 130.

Here, in FIG. 4, symbol TA-O indicates a group of video voltage output terminals, and the terminals which constitute the group of video voltage output terminals are respectively connected to corresponding video lines (DL).

Due to such constitution, in the liquid crystal display device which mounts the display control circuit 110 and the drain drivers 130 on the first substrate (SUB1) and performs the data transfer between the respective drain drivers, the wiring can be performed without making the lines intersect each other on the first substrate (SUB1) and hence, it is possible to manufacture a compact liquid crystal display device at a low cost.

Figure 3:
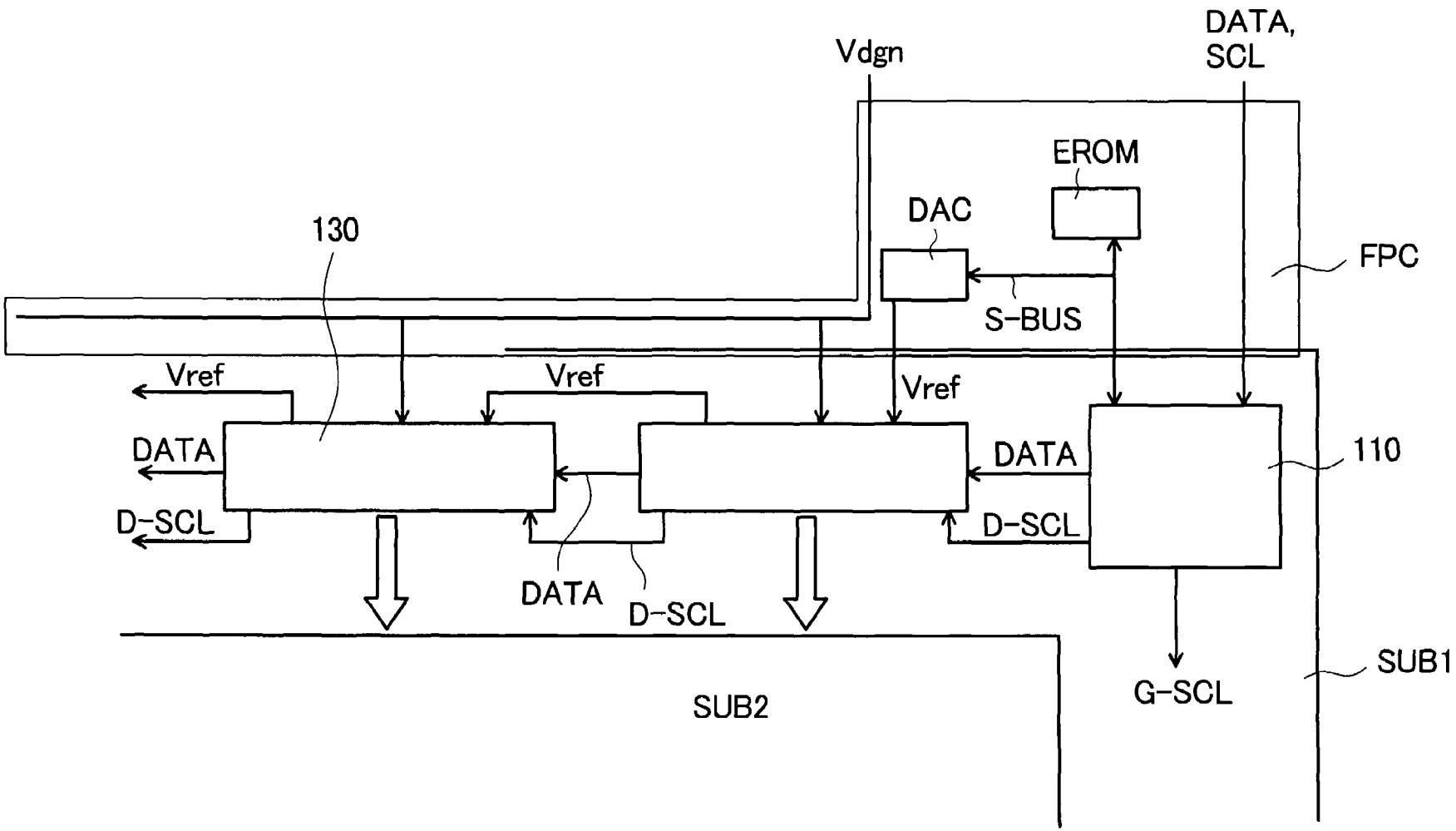
FIG. 3 is a view for explaining another example of the specific constitution of the liquid crystal display device of the embodiment according to the present invention.

FIG. 3 is a view for explaining another example of the specific constitution of this embodiment.

In the example shown in FIG. 3, a gray-scale reference voltage generating circuit (DAC) and an EEPROM (EROM) are mounted on the printed circuit board (FPC). Further, the gray-scale reference voltage generating circuit (DAC), the EEPROM (EROM) and the display control circuit 110 are connected with each other using a serial bus (S-BUS) such as an Inter Integrated Circuit bus. Here, gray-scale reference voltage data is stored in the EEPROM (EROM).

When a power source is supplied, the display control circuit 110 reads the gray-scale reference data of the EEPROM (EROM), and writes the read gray-scale reference voltage data in a register 66 in the gray-scale reference voltage generating circuit (DAC).

The gray-scale reference voltage generating circuit (DAC) supplies the gray-scale reference voltage (Vref) corresponding to the gray-scale reference voltage data written in the register 66 to the respective drain drivers 130.

The example shown in FIG. 3 can generate an optimum gray-scale reference voltage in conformity with the gray-scale/brightness characteristic of the liquid crystal display panel, for example.

Figure 5:
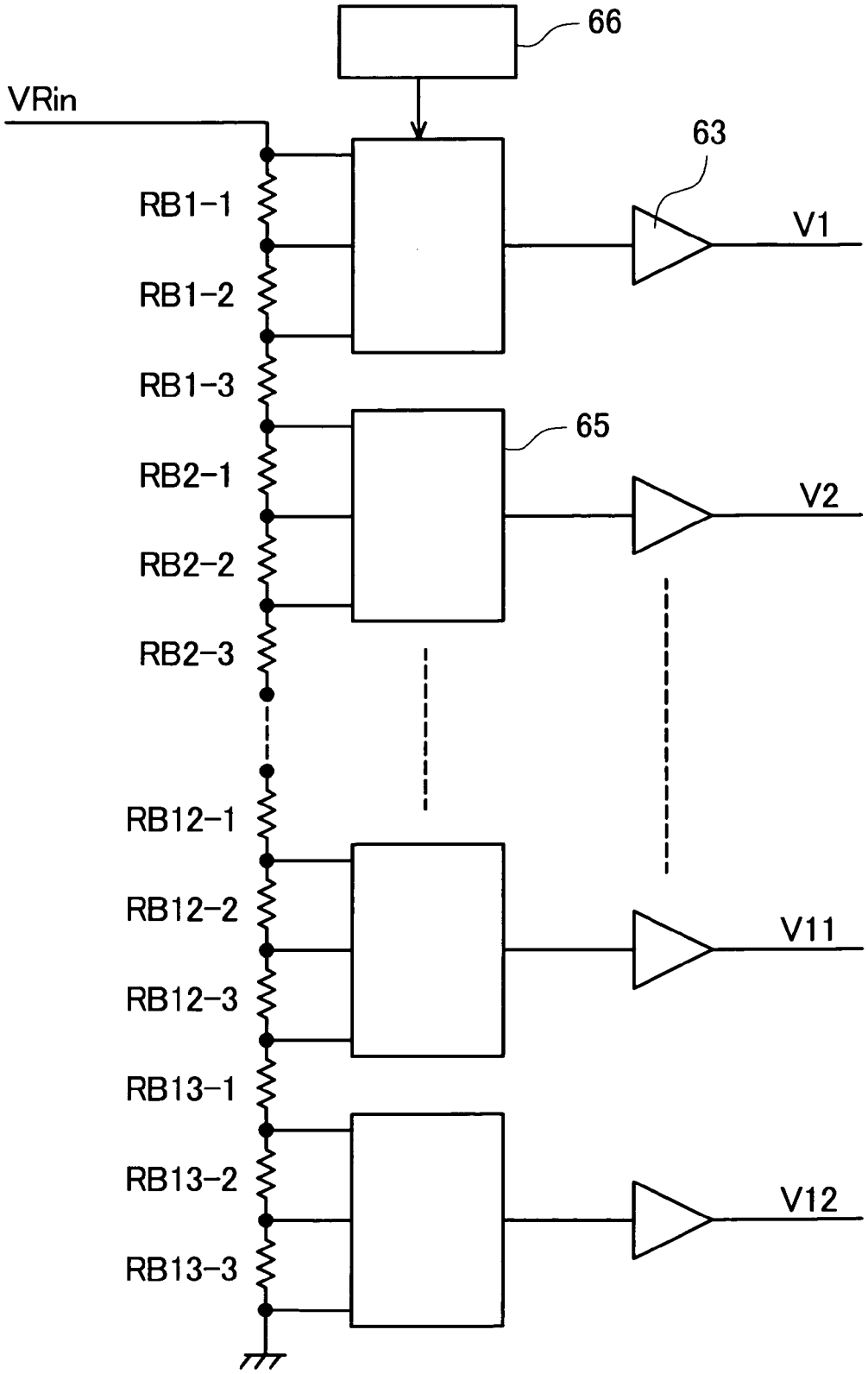
FIG. 5 is a view showing one example of a gray-scale reference voltage generating circuit shown in FIG. 3.

FIG. 5 is a view showing one example of the gray-scale reference voltage generating circuit (DAC) shown in FIG. 3.

In the example shown in FIG. 5, the gray-scale reference voltage generating circuit (DAC) is constituted of a resistance divided voltage circuit which is connected between a voltage VRin and a ground contact voltage (GND).

The gray-scale reference voltages V1 to V12 are set in accordance with the ratio of divided-voltage resistances, and output signals of the resistance divided-voltage circuits are outputted to the gray-scale voltage generating circuits of the drain drivers 130 respectively after being subject to the current amplification performed by buffer circuits 63.

Here, in FIG. 5, the divided voltage resistance is constituted of three resistances RBn-1, RBn-2, and RBn-3, and one of three resistances is selected by a selection circuit 65. Further, the selection circuit 65 is controlled based on the gray-scale reference voltage data which is stored in the register 66 from the display control circuit 110 such that the selection circuit 65 changes over the resistance to be selected by the selection circuit 65 and hence, voltage values of the gray-scale reference voltages (Vref) which are outputted to the respective drain drivers 130 are changed.

In general, the gray-scale reference voltage generating circuit (DAC) and the EEPROM (EROM) are respectively constituted of a small semiconductor chip (IC) compared to the display control circuit 110 and the drain driver 130 and, at the same time, the use of an inexpensive packaged product is mainstream in manufacturing the gray-scale reference voltage generating circuit (DAC) and the EEPROM (EROM). Accordingly, the display device can be realized at a low cost by mounting these parts on the printed circuit board (FPC) rather than mounting these parts on the first substrate.

The embodiments in which the present invention is applied to the liquid crystal display device have been explained heretofore, the present invention is not limited to the above-mentioned embodiments. That is, the present invention is applicable to all display devices including a large-sized high-definition display panel such as an organic EL display panel.

Although the invention made by inventors of the present invention have been specifically explained in conjunction with the embodiments heretofore, it is needless to say that the present invention is not limited to the above-mentioned embodiments and various modifications are conceivable without departing from the gist of the present invention.

What is claimed is:

1. A display device comprising:

a display panel including a plurality of pixels;

a plurality of drive circuits for supplying video voltages to the respective pixels; and a display control circuit which performs a drive control of the plurality of drive circuits, wherein the display panel includes a first substrate, the plurality of drive circuits and the display control circuit are mounted on a peripheral portion of one long side of the first substrate, a printed circuit board is connected to one long side of the first substrate, each drive circuit includes a group of power source voltage input terminals to which a power source voltage is supplied, a group of gray-scale reference voltage input terminals to which a gray-scale reference voltage is supplied, and a group of gray-scale reference voltage output terminals which sends a gray-scale reference voltage on a surface thereof facing the first substrate, the group of power source voltage input terminals, the group of gray-scale reference voltage input terminals, and the group of gray-scale reference voltage output terminals are arranged along a printed-circuit-board-side long side of each drive circuit, the group of power source voltage input terminals is arranged between the group of gray-scale reference voltage input terminals and the group of gray-scale reference voltage output terminals, the group of gray-scale reference voltage input terminals is arranged on a display-control-circuit-side of the group of power source voltage input terminals, the group of gray-scale reference voltage output terminals is arranged on a side of the group of power source voltage input terminals opposite to the display control circuit, a power source voltage is supplied to the group of power source voltage input terminals of each drive circuit via the printed circuit board, a gray-scale reference voltage is supplied to the group of gray-scale reference voltage input terminals of the start drive circuit via the printed circuit board, and a gray-scale reference voltage which is sent from the group of gray-scale reference voltage output terminals of the drive circuit of a preceding stage is supplied to the drive circuits other than the start drive circuit.

2. A display device according to claim 1, wherein the group of power source voltage input terminals is arranged on a center portion of the each drive circuit.

3. A display device according to claim 1, wherein the each drive circuit includes a group of display data input terminals and a group of display data output terminals on a surface thereof facing the first substrate, assuming the clockwise direction as the first direction and assuming the counterclockwise direction as the second direction as viewed from a surface of the each drive circuit on a side opposite to the surface of the drive circuit facing the first substrate, the group of display data input terminals is arranged in front of the group of gray-scale reference voltage output terminals in the first direction, and the group of display data output terminals is arranged in front of the group of gray-scale reference voltage output terminals in the second direction, display data output from the display control circuit is inputted to the group of display data input terminals of the start drive circuit, and display data which is outputted from the group of display data output terminals of the drive circuit of a preceding stage is supplied to the drive circuits other than the start drive circuit.

4. A display device according to claim 1, wherein the each drive circuit includes a group of control signal input terminals and a group of control signal output terminals on a surface thereof facing the first substrate, the group of control signal input terminals is arranged in front of the group of display data input terminals in the first direction, the group of control signal output terminals is arranged in front of the group of display data output terminals in the second direction, control signals output from the display control circuit are inputted to the group of control signal input terminals of the start drive circuit, and control signals output from the group of control signal output terminals of the drive circuit of a preceding stage are supplied to the drive circuits other than the start drive circuit.

5. A display device according to claim 1, wherein the group of display data input terminals is arranged along a display-control-circuit-side short side of the each drive circuit, the group of display data output terminals is arranged along a short side of the each drive circuit on a side opposite to the display control circuit, the group of control signal input terminals is arranged along a display-control-circuit-side long side of the each drive circuit on a side of the each drive circuit opposite to the printed circuit board, and the group of control signal output terminals is arranged along a long side of the each drive circuit opposite to the display control circuit on a side of the each drive circuit opposite to the printed circuit board.

6. A display device according to claim 1, wherein a power source circuit and a gray-scale reference voltage generating circuit are mounted on the printed circuit board.

7. A display device according to claim 1, wherein a storage means for storing the gray-scale reference voltage data is mounted on the printed circuit board, the gray-scale reference voltage generating circuit includes a register, the display control circuit reads the gray-scale reference data stored in the storage means and outputs the gray-scale reference data to the gray-scale reference voltage generating circuit, and the gray-scale reference voltage generating circuit stores the gray-scale reference voltage data input from the display control circuit in the register, and generates gray-scale reference voltages based on the gray-scale reference voltage data stored in the register.

* * * * *